US005400605A

United States Patent [19]

Jeong

[11] Patent Number: 5,400,605

[45] Date of Patent: Mar. 28, 1995

[54] ICE MAKER CONTROL METHOD

[75] Inventor: Sung-Ki Jeong, Suwon, Rep. of Korea

[73] Assignee: Samsung Electronics Co., Ltd., Suwon, Rep. of Korea

[21] Appl. No.: 220,196

[22] Filed: Mar. 30, 1994

[30] Foreign Application Priority Data

Feb. 15, 1994 [KR] Rep. of Korea ..... 94-2665

[51] Int. Cl.[6] ..... F25C 5/06

[52] U.S. Cl. ..... 62/72; 62/353

[58] Field of Search ..... 62/72, 353

[56] References Cited

U.S. PATENT DOCUMENTS

| | | | |
|---|---|---|---|
| 3,071,933 | 1/1963 | Shoemaker | 62/353 X |
| 3,383,876 | 5/1968 | Frohbieter | 62/72 |
| 3,580,009 | 5/1971 | Snow | 62/72 X |
| 4,332,146 | 6/1982 | Yamazaki et al. | 62/353 |

FOREIGN PATENT DOCUMENTS

| | | | |
|---|---|---|---|
| 4-260763 | 9/1992 | Japan | 62/72 |
| 4-260764 | 9/1992 | Japan | 62/72 |

*Primary Examiner*—William E. Tapolcai

*Attorney, Agent, or Firm*—Burns, Doane, Swecker & Mathis

[57] ABSTRACT

Ice pieces are discharged from an ice-making container into a tray disposed therebeneath by the procedure of inverting the container and twisting it in an initial direction of rotation to discharge most of the ice pieces into a first region of the tray, and then twisting the tray in a direction opposite the first direction to discharge residual ice pieces into the tray. The initial direction of twisting occurring during each such procedure is opposite the initial direction of twisting performed during a prior procedure, so that the majority of ice pieces discharged during each procedure falls into a different region of the tray than during a prior procedure. This results in a more uniform distribution of ice pieces in the tray. Instead of twisting the container in two directions during each procedure, it could be twisted in only one direction.

10 Claims, 7 Drawing Sheets

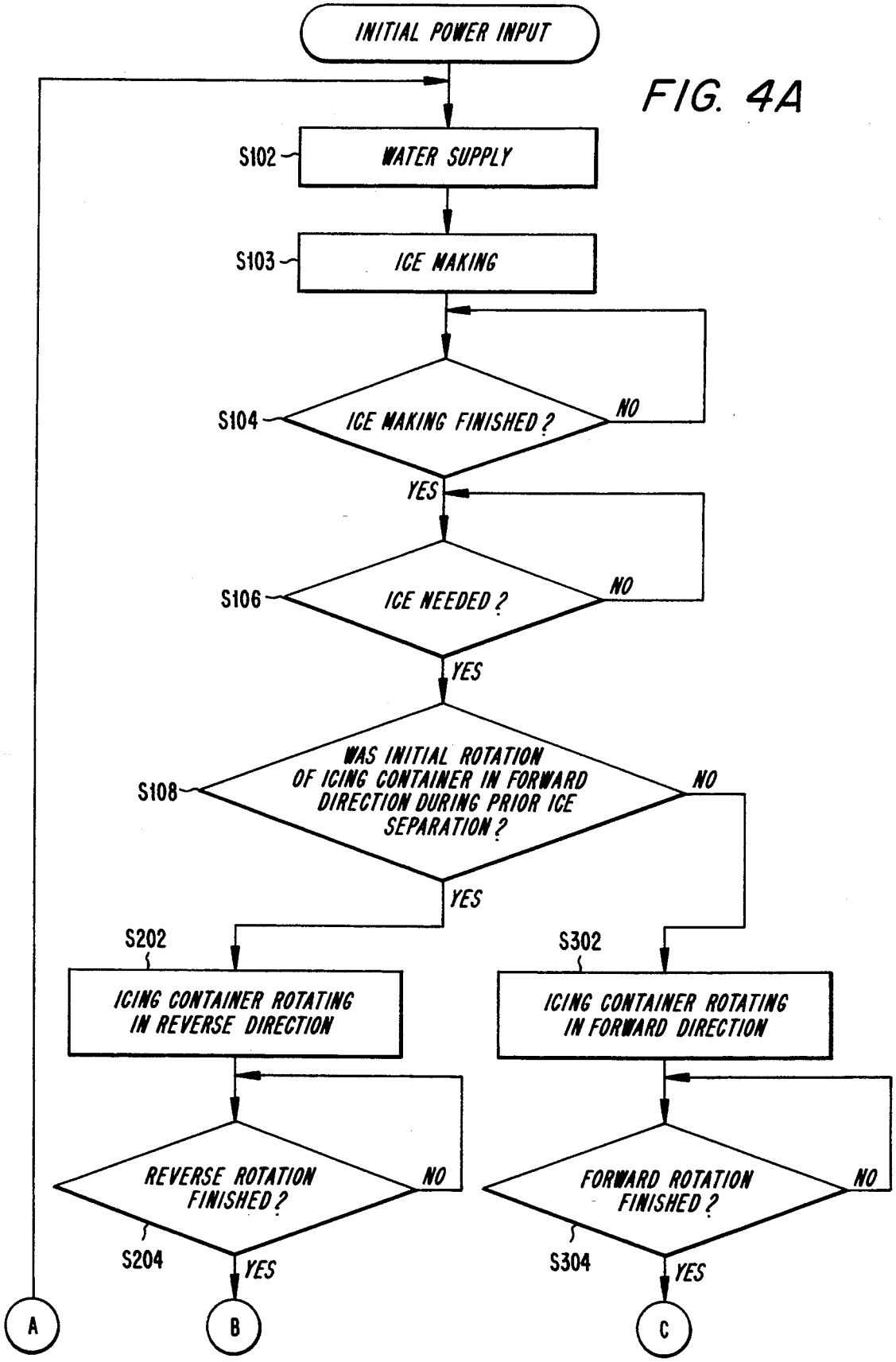
INITIAL POWER INPUT
FIG. 4A
S102
WATER SUPPLY
S103
ICE MAKING
S104
ICE MAKING FINISHED ?
NO
YES
S106
ICE NEEDED ?
NO
YES
S108
WAS INITIAL ROTATION OF ICING CONTAINER IN FORWARD DIRECTION DURING PRIOR ICE SEPARATION ?
NO
YES
S202
ICING CONTAINER ROTATING IN REVERSE DIRECTION
S302
ICING CONTAINER ROTATING IN FORWARD DIRECTION
REVERSE ROTATION FINISHED ?
NO
S204
YES
FORWARD ROTATION FINISHED ?
NO
S304
YES
A
B
C

ICE MAKER CONTROL METHOD

BACKGROUND OF THE INVENTION

1. Field of the Invention

The present invention relates to an ice maker, and more particularly to an ice maker control method for completely separating from an icing container the ice frozen by the ice maker in a freezing chamber to thereby increase an ice-separating efficiency, and furthermore for evenly storing the ice in an ice storage tray when the ice is separated from the icing container, so that ice storing capacity of the storage tray can be improved.

2. Description of Prior Art

Generally, an ice maker is an apparatus wherein cold air is supplied to water to freeze the same, thereby producing the ice when the water is supplied from a water supplier to an icing container, so that the ice can be stored in the storage tray.

Meanwhile, the ice maker is disposed with a capacity ice detecting unit in order to prevent the ice from overflowing from the ice storage tray.

The capacity ice detecting unit detects whether the ice is fully loaded in the storage tray before the ice is separated from the icing container.

If packed ice is detected by the detecting unit, ice separation is not performed, nor is the water supplied.

However, in one conventional ice maker (see FIG. 6) the container 1 is manipulated (i.e., twisted only once during each) ice separating operation for separating the ice from the icing container, where by there my result an incomplete separation of the ice from the container.

If the water is re-supplied to the container while the ice is not fully separated from the container, an amount of water (i.e., as much as the volume of the remaining ice) will overflow the container.

Furthermore, as shown in FIG. 6 the container is always rotated in the same direction to separate the ice, thereby accumulating the ice cubes on one side in the storage tray, so that there frequently occur occasions where the detecting unit detects the storage tray as being full when actually it is not, causing an icing operation stoppage.

In other words, as illustrated in FIG.6, the ice 8 separated from the container 1 is accumulated on one side in the storage tray 4, so that a capacity ice detecting lever 5 is prevented from moving to the lower side ("C" direction) by the ice 8 during detection of the capacity ice.

Accordingly, an occasion where the ice 8 is not fully loaded in the storage tray 4 is interpreted as a full state causing the icing not to be realized.

In Japanese laid open patent application No. Tokai Hei 4(1992)-260764 entitled "Automatic-Ice Producing Apparatus", a technique is disclosed for separating completely the ice from the container.

In the apparatus in accordance with the Japanese Patent the water is stored in an icing dish for icing, and the icing dish is rotated to an ice-separating position by a driving unit after the water is iced for separation of the ice, In particular, the driving unit twists the icing dish 1 (see FIG. 6) in a reverse rotational direction at the start of ice-separation operation ("A" direction in FIG. 6) and then twists the same in the right direction ("B" direction in FIG.6) to twist the dish at a predetermined angle ($\beta$) from the ice-separation position, so that the ice can be separated from the container.

An ice-separation rate therefore is considerably improved as the dish is twisted to the left and right for separation of the ice.

However, even in the Japanese Patent No. 4-260764, the ice separation is performed only in one direction, so that the ice is accumulated on one side in the storage tray, thus reducing the ice-storing capability of the storage tray.

SUMMARY OF THE INVENTION

Accordingly, it is an object of the present invention to provide an ice maker control method for performing a complete ice-separation and for storing the separated ice evenly in the storage tray.

The ice maker control method in accordance with the present invention for achieving the object of the invention, comprises the steps of:

rotating an icing container to an ice-separation position in the forward direction during one ice separation procedure, separating the ice by twisting the container, rotating again the container to an ice separation position in the reverse direction to thereafter twist the container for ice separation and rotating the container again in the forward direction to thereby maintain the container horizontally; and rotating the icing container to an ice-separation position in the reverse direction during a subsequent ice separation procedure, separating the ice by twisting the container, rotating again the container to an ice separation position in the forward direction to thereafter twist the container for ice separation and rotating the container again in the reverse direction to reorient the container horizontally.

BRIEF DESCRIPTION OF THE DRAWINGS

FIGS. 4A and 4B depict a flow chart for explaining the embodiment of the ice maker control method in accordance with the present invention.

DETAILED DESCRIPTION OF PREFERRED EMBODIMENT OF THE INVENTION

Figure 1:
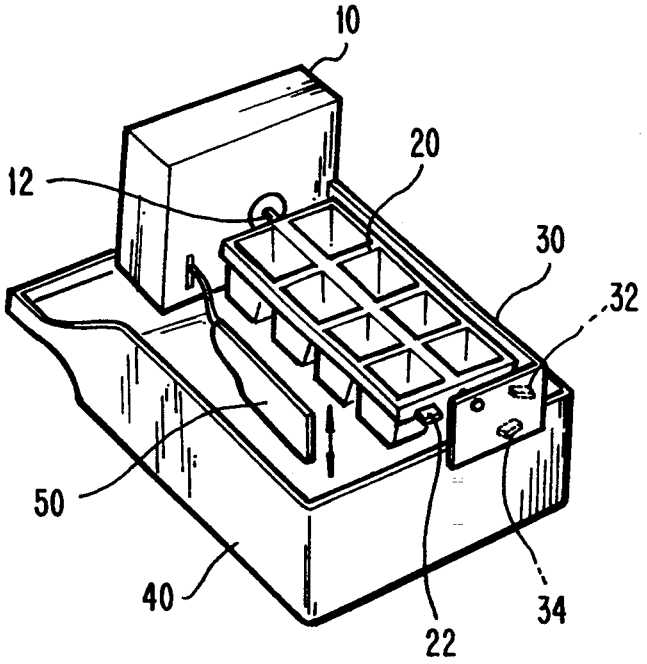
FIG. 1 is a perspective view of an ice maker to which an ice maker control method according to the present invention is applied.

In FIG. 1, an icing container 20 is partitioned for water storage. When a plurality of partitioned spaces in the icing container is supplied with a predetermined quantity of water from a supply unit disposed in a refrigerating chamber, cold air is supplied to freeze the water.

A rotating shaft 12 is disposed in a center portion of the container 20 which rotates around the axis of the shaft 12.

A temperature sensor (not shown) is attached to a bottom surface of the container 20.

The temperature sensor detects water temperatures or ice temperatures in the container 20, which is inputted to a control unit 10.

The control unit 10 determines a state of the frozen ice by way of the temperatures detected by the temperature sensor 20.

A rotating shaft driving motor and the like are disposed in the control unit 10.

Furthermore, a rotation encoder is disposed in the control unit 10 in order to detect a rotation amount of the rotating shaft 12.

At this time, it should be apparent that the rotation amount of the rotating shaft 12 can be detected without the rotation encoder if the rotating shaft driving motor is replaced by a stepping motor.

A capacity ice detection lever 50 maintains a predetermined distance from the container 20 to thereby let the same stand clear of the container when the container 20 is rotated.

The capacity ice detecting lever 50 is moved up and down by way of control of the control unit 10.

In other words, if it is determined that the temperature in the container 20 is at a freezing level, the control unit 10 attempts to move the capacity ice detecting lever 50 downwards.

If an ice storage tray 40 is in a full-capacity storage state when the lever 50 tries to move downwards, the lever 50 is not moved downwards and the unit 10 determines that the tray is full.

At this time, since the storage tray 40 is considered as full, the control unit 10 does not rotate the container 20, and if the storage tray 40 is not full, the control unit 10 rotates the container 20 to thereby drop the ice produced by the container 20 towards the storage tray 40.

Meanwhile, one end of the rotating shaft 12 of the container being rotated by the rotating shaft driving motor disposed on the control unit 10 is rotativeby disposed on a fixed bracket 30.

The fixed bracket 30, having a predetermined distance from one end of the rotating shaft facing the control unit 10 is formed with first and second stoppers 32 and 34, and a protrusion 22 is formed on the container 20.

The protrusion 22 formed on the container 20 normally lies along a horizontal line (X—X' axis). Once the container 20 is rotated left or right at a predetermined angle (128 degrees for the present invention) around the rotating shaft 12, the protruder will engage the first stopper 32 or the second stopper formed on the fixed bracket 30.

Figure 2:
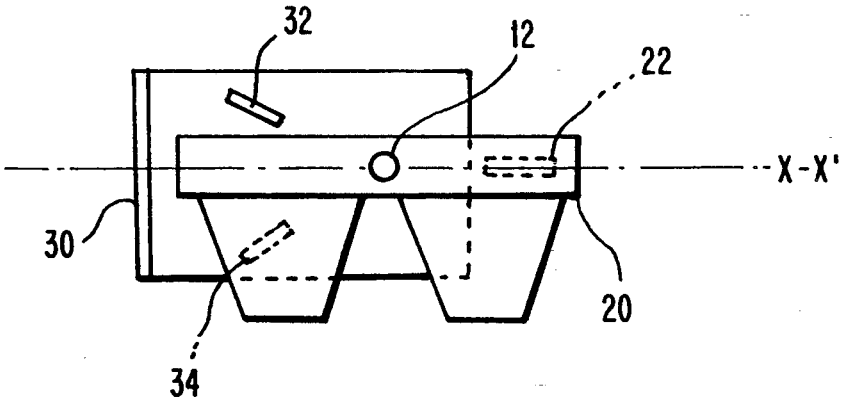
FIG. 2 is an end view of the ice maker of FIG. 1 showing how an icing container in the ice maker is disposed where the method of the present invention is applied.

FIG. 2 is a frontal perspective view of the embodiment for illustrating how the container 20 is normally angularly oriented with respect to the fixed bracket 30 when seen from the control unit 10 (see FIG. 1).

According to FIG. 2, one end of the fixed bracket 30 is formed with the first and second stoppers 32 and 34.

Furthermore, one end of the container 20 situated opposite the surface formed with the stoppers 32 and 34 is formed with the protrusion 22.

The stoppers 32, 34 are spaced from the protrusion 22 by the same angular distance but in opposite angular directions therefrom.

Figure 3A:
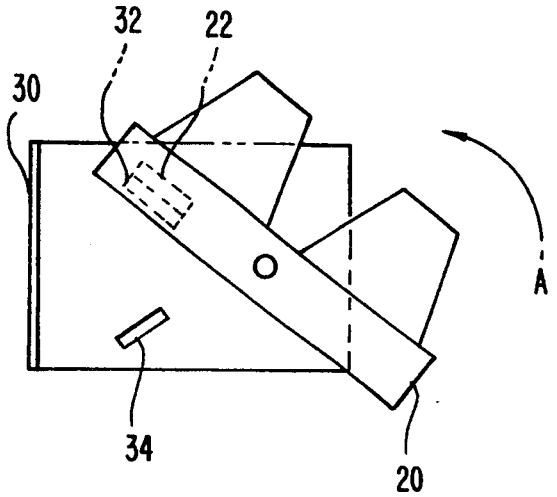
FIGS. 3A–3D are end views of the ice maker of FIG. 2 showing a respective operational states of the icing container in accordance with the ice maker control method of the present invention.
Figure 3B:
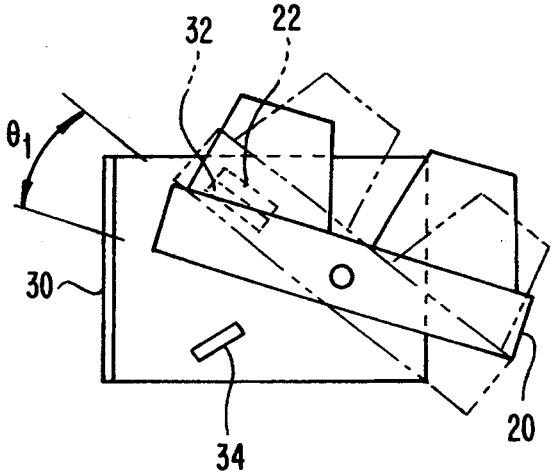
Figure 4B:
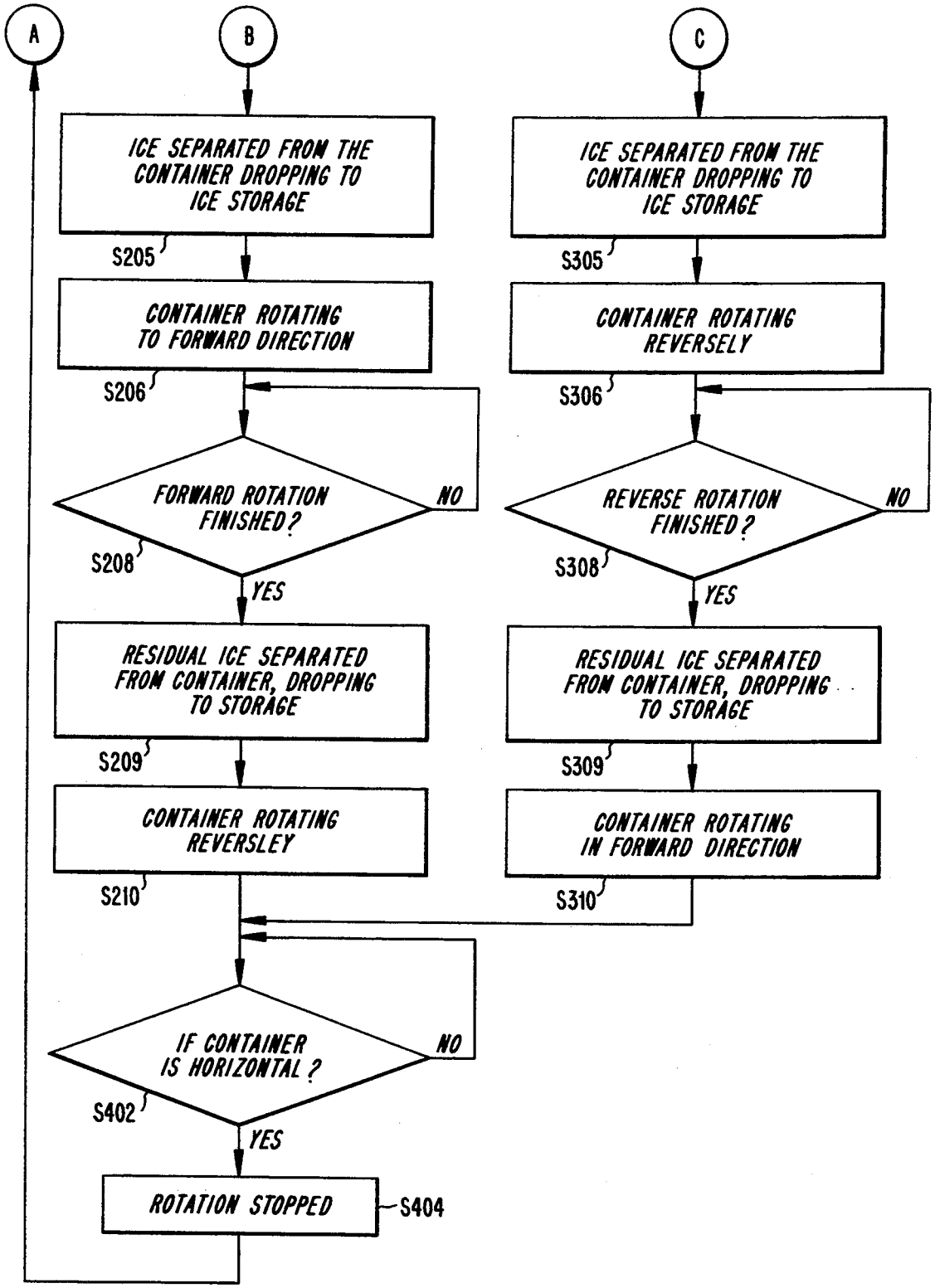

Hereinafter, two preferred embodiments of the ice maker control method of the present invention will be described in detail with reference to an end view of the embodiment for showing an operational state of the icing container 20 as illustrated in FIG. 2 and FIGS. 3A–3B and with reference to a flow chart illustrated in FIG. 4A, 4B.

In the first embodiment, the icing container is twisted in two directions during each ice-separation procedure, whereas in the second embodiment the icing container is twisted in only one direction during each ice-separation procedure. In both embodiments the twisting is performed such that the positional relationship between the container and the storage tray as the ice is discharged into the tray different is in successive ice-separation procedures, whereby the ice becomes more evenly distributed in the tray. In the first embodiment, this is achieved by reversing the twisting direction sequence from one ice-separation procedure to the next (e.g., a forward-then-rearward twisting sequence during one procedure, and a rearward-then-forward twisting sequence during the next procedure). In the second embodiment, the single twisting direction is reversed from one procedure to the next (e.g., a forward twisting during one procedure, and a rearward twisting during the next procedure).

THE FIRST EMBODIMENT

First of all, as seen in the flow chart in FIG. 4, if an initial power source is inputted to the ice maker, flow proceeds to the control unit 10 (see FIG. 1) to thereby supply water, step S102.

In other words, the level of the icing container 20 is checked and if the container 20 is not horizontal, a motor in the control unit 10 is rotated reversely for making the container horizontal and a water supply unit is controlled to supply water into the container 20.

Now, flow advances to step S103 to perform icing. Cold air is supplied to the icing container 20 at step S103 to thereby cause the water to freeze.

Then, flow proceeds to step S104 to determine whether the icing has been completed.

In other words, the control unit 10 determines whether the water in the container 20 has been frozen by the cold air according to an input of a temperature sensor (not shown) disposed on the bottom surface of the container 20.

As a result of step S104, if it is determined that the icing has been completed, flow proceeds to step S106 to determine whether the tray 40 is filled to the brim with ice.

At step S106, the capacity ice sensing lever 50 (see FIG. 1) is urged downwardly for testing and if the lever is not moved downwards, it is determined that the ice has filled the storage tray 40 (see FIG. 1).

If the lever 50 can be lowered, it can be determined that the storage tray 40 is not full.

Even though the icing has been determined as completed, if the tray 40 is determined to be full, the icing process is stopped temporarily to thereby be in a standby position until the ice is picked out from the storage tray 40.

Meanwhile, as a result of step S106, if the storage tray is determined as being empty, flow proceeds to step S108 to determine whether an initial rotating direction of the container 20 was in the forward (clockwise) direction B during a prior ice separation process.

In the initial rotating direction of the container 20 determined to have been in the forward or rearward (counterclockwise) direction A during the prior ice separation process, flow advances to steps S202 and S204 to rotate the container 20 in the reverse direction at a predetermined angle (153 degrees in the present invention).

If the icing container 20 is rotated in the reverse direction, the protrusion 22 formed on the container 20 engages the first stopper 32 formed on the fixed bracket 30 illustrated in FIG. 3A.

Then, if the container 20 continues to be rotated in the reverse direction, the end of the container 20 where the protrusion 22 is formed (shown inn broken lines in FIG. 3B) is stopped of rotation by the first stopper 32 as illustrated in FIG. 3*b* and the opposite end of the container 20 (shown in solid lines) keeps rotating to thereby twist the container 20.

If the container 20 is twisted, (step S205), the ice is separated from the container 20 to thereby drop to the ice storage tray 40.

At this time, the twist angle ($\theta 1$) of the container 20 is determined by the position of the first stopper 32 and rotating angle of the container 20.

In the present invention, as the rotating angle of the container 20 is given at 153 degrees, if the twist angle ($\theta 1$) of the container 20 is to be set at 25 degrees, the first stopper should be so located that the first stopper 32 and the protruder 22 contact each other when the container 20 has been rotated at 128 degrees.

As seen in the foregoing, when the ice separation is completed by rotation of the container 20 in the reverse (counterclockwise) direction, flow proceeds to steps S206 and S208 to rotate the container 20 in the forward (clockwise).

At this time, the icing container 20 rotates by 306 degrees in the forward direction from the FIG. 3B position (i.e., $153°+153°=306°$)

Figure 3C:
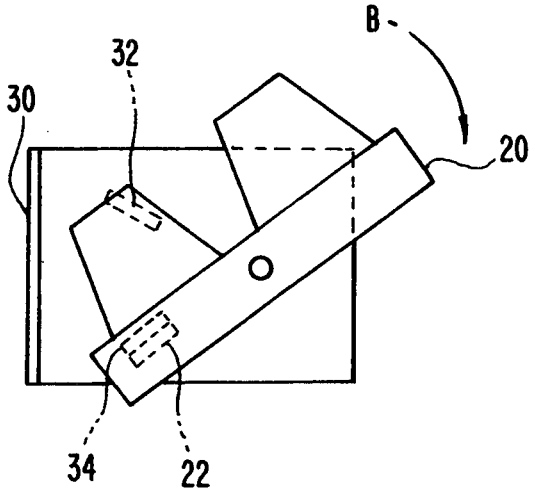

If the container 20 is rotated in the forward direction at steps S206 and S208, as illustrated in FIG. 3*c*, the protrusion 22 formed on the container 20 abuts the second stopper 34 formed on the fixed bracket 30.

At this point the container 20 will have been rotated 281 degrees from the FIG. 3B position (i.e., $153°+128°=281°$).

Figure 3D:
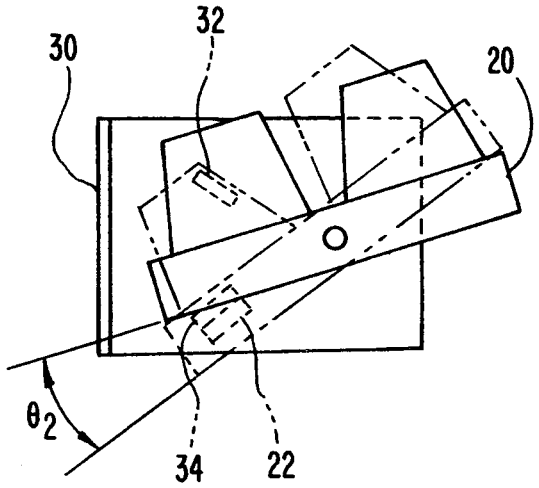

Then, if the container 20 continues to be rotated forwardly, the end of the container 20 where the protruder 22 is formed, as illustrated in FIG. 3D, is stopped of rotation by the second stopper 32 whereas the opposite end of the container 20 is kept rotating to thereby twist the container 20.

If the container 20 is twisted, flow proceeds to step S209 and wherein the ice not separated from the container 20 when the container 20 was previously twisted is now separated to thereby drop to the storage tray 40.

At this time, a twisted angle of the container ($\theta 2$) is determined by the position of the second stopper 34 and a rotating angle of the container 20, which angle ($\theta 2$) is the same as the twisted angle ($\theta 1$) mentioned above.

In other words, the twisted angle ($\theta 2$) of the icing container 20 becomes 25 degrees.

When the steps S206, 208 and 209 are completed, flow proceeds to step S210 to rotate the container 20 in the reverse direction and a determination is made as to whether the container 20 is horizontal, step S402.

As a result of step S402, if the container 20 is horizontal, flow proceeds to step S404 to stop the rotation of the container 20. Then, water is again supplied at step S102.

When the water is supplied to the container 20 at step S102, flow proceeds to step S103 to perform the icing.

Then, flow advances to step S104 to determine whether the icing has been completed.

As a result of step S104, if it is determine that the icing has been completed, flow proceeds to step S106 to thereby determine whether the ice has filled the storage tray 40.

As a result of the step S106, if it is determined that the storage tray 40 is not filled with the ice, flow advances to step S108 to determine whether the initial rotating direction of the container 20 had been in the forward direction during the prior ice-separating process.

It will be recalled that the initial rotating direction of the container 20 during the previous ice-separation process was in the reverse direction. Thus, flow proceeds to steps S302 and S304, thereby rotating the container 20 in the forward direction at a predetermined angle (153 degrees in the present invention).

If the container 20 is rotated in the forward direction, as illustrated in FIG. 3C, the protrusion 22 formed on the container 20 abuts the second stopper 34 disposed on the fixed bracket 30.

Then, if the container 20 is kept rotating in the forward direction, as illustrated in FIG. 3D, the end of the container where the protrusion 22 is disposed is stopped of rotation by the second stopper 34 whereas the opposite end of the container 22 is kept rotating to thereby twist the container 20.

If the container 20 is twisted, as in step S305, the ice is separated from the container 20 to drop to the storage 40.

After the ice is separated by way of rotation of the container 20 in the forward direction as explained in the foregoing, flow proceeds to steps S306 and S308 to rotate the container 20 in the reverse direction.

At this time, the reverse rotating angle of the container 20 is 306 degrees.

If the container 20 is rotated in the reverse direction at steps S306 and S308, as shown in FIG. 3A, the protrusion 22 formed on the container 20 abuts the first stopper 32 disposed on the fixed bracket 30.

If the container is continuously rotated to the reverse direction as illustrated in FIG. 3B, the end of the container 20 where the protruder 22 is disposed is stopped of rotation by the first stopper 32 while the opposite end of the container 20 is kept rotating to thereby twist the container 20.

If the container 20 is twisted, flow proceeds to step S309 and as illustrated in FIGS. 3C and 3D, the ice not separated from the container 20 when the container 20 was rotatively twisted in the forward direction is separated to thereby drop to the storage tray 40.

When the steps S306, 308 and 309 are completed, flow advances to step S310 to thereby rotate the container 20 again in the forward direction, and flow proceeds to step S402 to determine whether the container 20 is in the horizontal state.

As a result of step S402, if the container 20 is horizontal, flow proceeds to step S404 to thereby stop rotation of the container 20 and perform operations subsequent to step S102 for supplying water to the container 20 again.

As seen from the foregoing, according to the ice maker control method of the present invention, the icing container is rotated in a predetermined direction (by way of example, in the forward direction B) once the icing is completed but twisting of the container is started when the container is rotated approximately 128 degrees, and the same is continuously rotated up to approximately 153 degrees to thereafter separate the ice therefrom.

Right after these processes, the icing container is rotated in the reward or reverse direction A up to approximately 153 degrees counterclockwise not stopping at the horizontal position, whereby the container is starting to be twisted when rotated up to approximately 128 degrees (twisting angle 25 degrees) to thereby separate the ice possibly still stuck in the container.

Then, the container is rotated in the forward direction to reach a horizontal position, and then is stopped rotation and water supply is processed.

During the next process of ice separation, the container is firstly rotated in the reverse direction because the previous ice separation process was begun with rotation in the forward direction.

In other words, the icing container is rotated reversely (counterclockwise) approximately 153 degrees but when the same is rotated approximately 128 degrees, the twisting of the container is started, initial separation of ice is performed, and the container is rotated forwardly by approximately 153 degrees with a twist of approximate 25 degrees for a second separation of the ice.

The container is then returned to an original position.

As seen in the foregoing according to the present invention, the icing container is first rotated alternately in the forward and reverse directions for an initial separation of the ice whereby the accumulation of ice in the ice storage tray is done evenly due to the alternate initial rotation to thereby improve the ice accumulation capacity.

ANOTHER EMBODIMENT

In the second embodiment, the ice separation procedure is the same as that of the first embodiment, except that the icing container is only twisted once (not twice) during each procedure, the direction of the twisting being opposite that of the previous procedure.

Figure 5A:
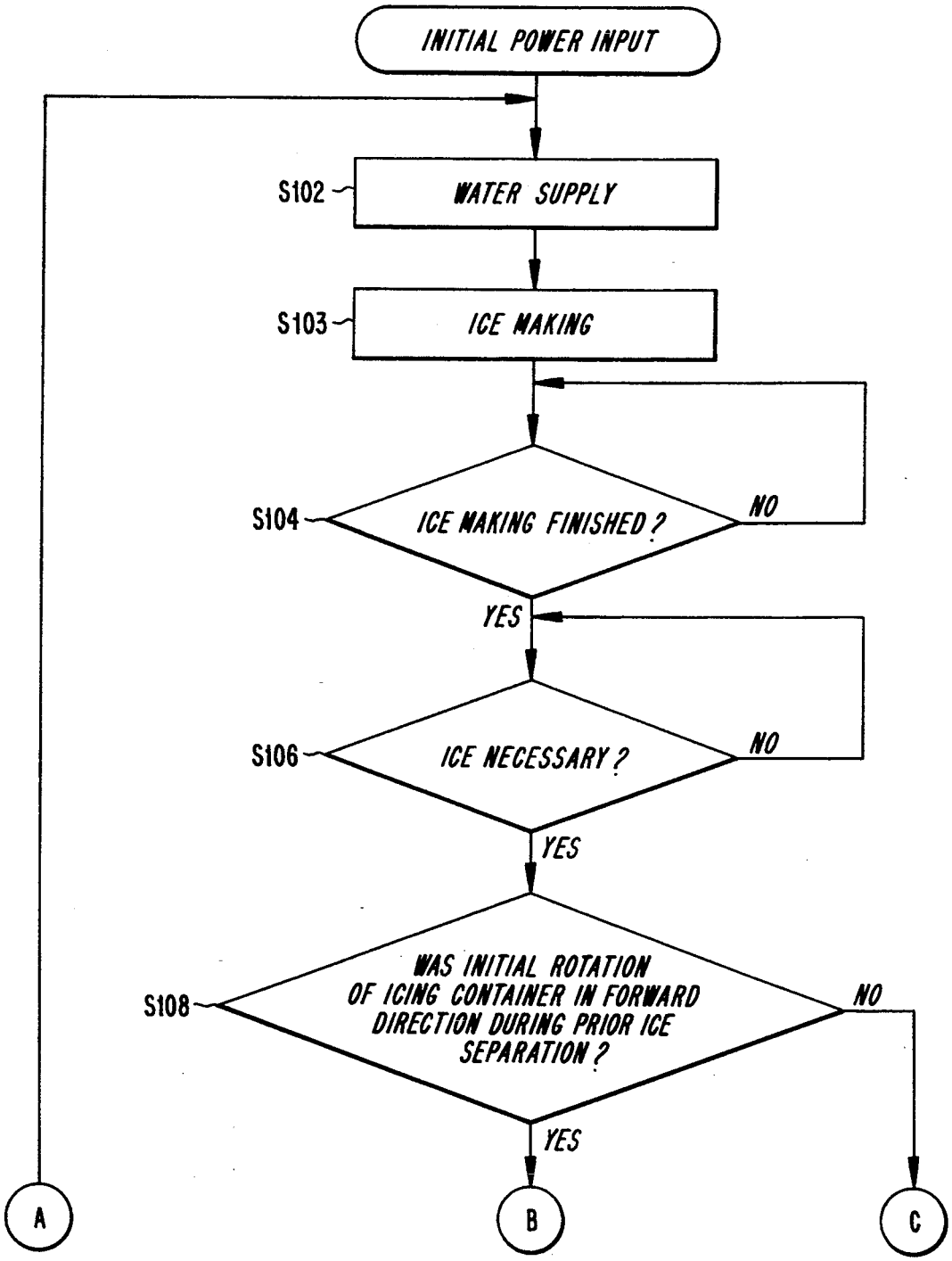
FIGS. 5A and 5B depict a flow chart for explaining another embodiment of the ice maker control method in accordance with the present invention.
Figure 5B:
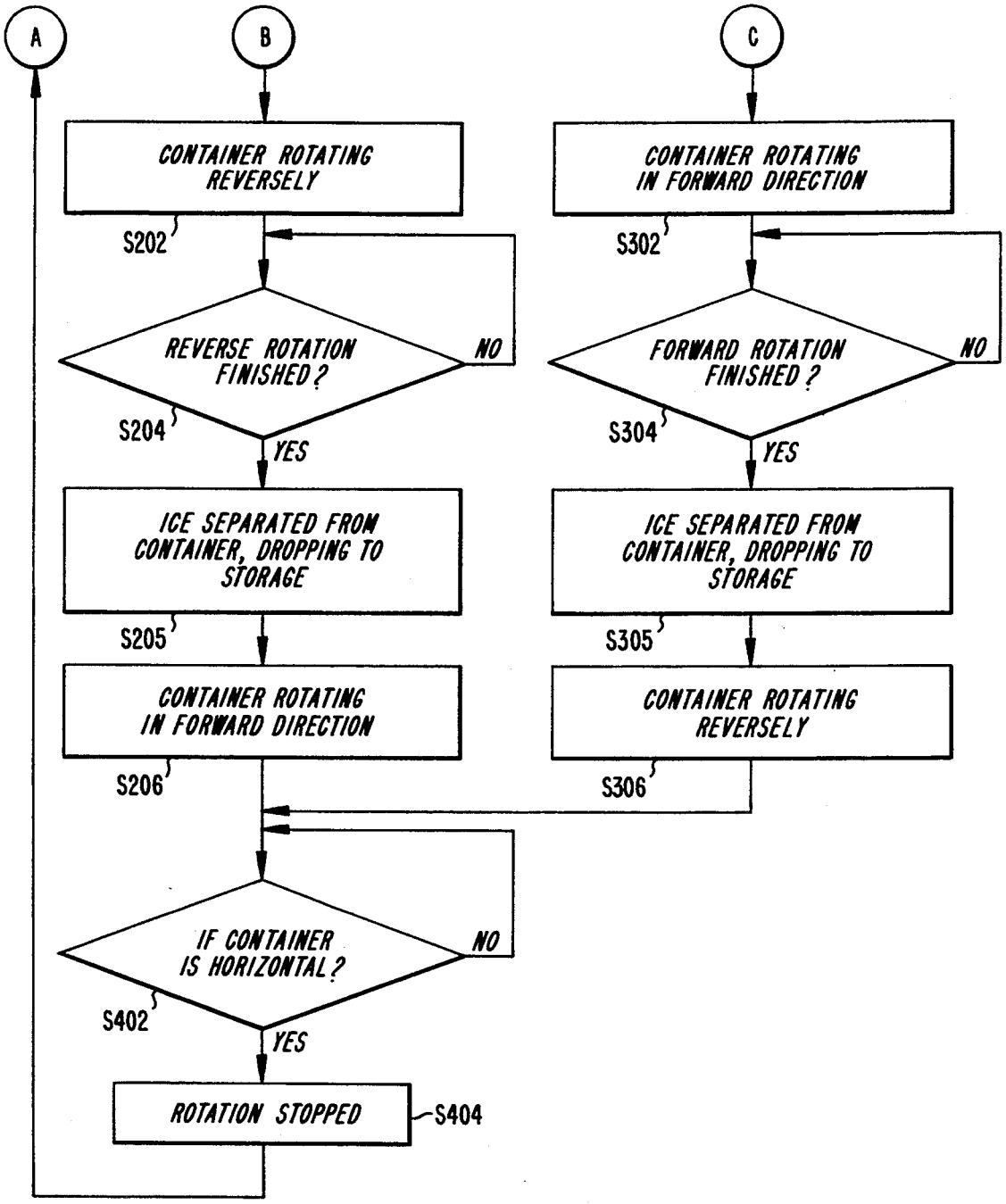
Figure 6:
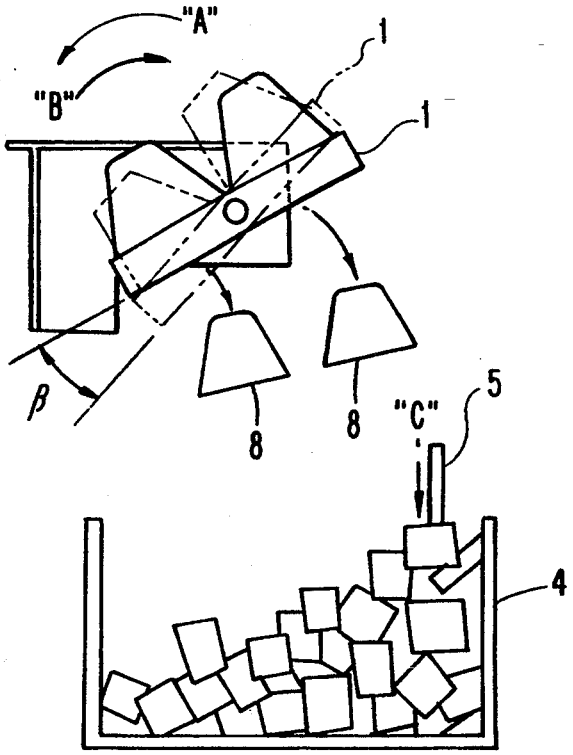
FIG. 6 (PRIOR ART)
FIG. 6 is a view similar to FIG. 2 for explaining a conventional ice maker control method.

In a flow chart of the other embodiment in FIG. 5A and 5B, the steps of water supply, icing and capacity ice discrimination covering steps, S102, S103, S104 and S106, the step of determining the initial rotational direction of the icing container during the prior ice separation covering step S108, the steps of initially rotating the container opposite to that of the prior ice separation direction for ice separation covering steps S108, S202, S204 and S205 and steps S302, S304 and S305 have already been explained in connection with the first embodiment.

However, in order to assist understanding of a second embodiment, steps subsequent to the step S106 for determining the state of the ice storage tray will be described.

As a result of step S106, if it is determined that the storage 40 is empty, flow proceeds to step S108, to determine whether the ice separating direction, i.e., the twisting direction, of the prior process.

Was in the forward direction.

As a result, if the direction of the twisting rotation in the previous procedure was forward, flow advances to steps S202 and S204 to rotate the container in the reverse direction at a predetermined angle (by way of example, 153 degrees )

If the container 20 is rotated to 128 degrees in the reverse direction, the protrusion 22 formed on the container, as illustrated in FIG. 3*a*, abuts the first stopper 32 formed on the fixed bracket 30.

Then, if the container 20 is continuously rotated to the reverse direction, the end of the container 20 where the protrusion 22 is disposed, as illustrated in FIG. 3B, is stopped of rotation by the first stopper 32, whereas the opposite end of the container is kept rotating to thereby cause the container 20 to be twisted.

If the container 20 is twisted, the ice, as in step S205, is separated from the container 20 to thereafter drop to the ice storage tray 40.

At this time, the twisting angle ($\theta 1$) of the container 20 is determined by the position of the first stopper 32 and the rotating angle of the container 20.

Accordingly, when the container is rotated 153 degrees, the twisting angle of the container 20 becomes 25 degrees because the first stopper 32 and the protrusion contact each other after 128 degrees.

As described above, when the ice separation is completed flow proceeds to step S206, thereby rotating the container 20 again in the forward direction and step S402 determines at whether the container 20 is in the horizontal position.

As a result of step S402, if the container 20 is horizontal, flow advances to step S404 to stop rotating the container 20 and water is supplied at step S102.

Following the water supply to the container 20, flow proceeds to step S103 to perform the icing and advances to step S104 to determine whether the icing has been completed.

As a result of the discrimination at step S104, if it is determined that the icing has been completed, flow proceeds to step S106 to determine whether the ice has filled the storage tray 40.

As a result of step S106, if it is not determined that the storage 40 has been filled with the ice, flow proceeds to step S108 to determine whether the rotational twisting direction of the container 20 was in the forward direction during the prior ice separation process.

As a result of step S108, because the rotational twisting direction of the container during the previous ice separation process was in the reverse direction just like in step S204, the flow advances to steps S302 and S304 to thereby rotate the container 20 in the forward direction at a predetermined angle (for example, 153 degrees)

If the container 20 is rotated in the forward direction, the protrustion 22 formed on the container 20, as illustrated in FIG. 3*c*, abuts the second stopper 34 disposed on the fixed bracket 30.

Then, if the container 20 is continuously rotated in the forward direction, the end of the container 20 where the protrustion 22 is formed as illustrated in FIG. 3*d* is stopped of its rotation by the second stopper 34, and the opposite end of the container is continuously rotated to thereby twist the container 20.

If the container 20 is twisted, the ice is separated from the container 20 as in step S305 to thereby drop to the storage tray 40.

Following the rotation of the container in the forward direction, flow proceeds to step S306 to rotate the container 20 in the reverse direction and at step S402 it is determined whether the container 20 is horizontal.

As a result of step S402, if the container 20 is horizontal, flow proceeds to step S404 to stop rotation of the container 20 and perform again operations subsequent to the water supply.

As seen from the foregoing, according to the ice maker control method of the present invention, ice distribution in an ice storage tray becomes evenly balanced by the alternating forward/rearward ice separation processes, which has made it possible for more ice to accumulate.

Furthermore, according to the ice maker control method of the present invention, the ice in the ice storage tray is prevented from being lumped by the ice stuck in the icing container.

The foregoing description and drawings are illustrative and are not to be taken as limiting.

Still other variations and modifications are possible without departing from the spirit and scope of the present invention.

Specifically, even though the rotating angle and twisting angle of the icing container and the like have been described in detail in the foregoing description, the spirit of the present invention is not limited to the above embodiments.

Still furthermore, the icing container, the shape of the fixed bracket, the position of the stopper and the like, and construction of the ice maker have been disclosed simply as embodiments, and construction of the ice maker for implementation of the present invention can be provided in various shapes.

It should also be apparent that the forward-then-reverse rotational sequence described previously can alternatively be changed to to a reverse-then-forward sequence and still obtain the objects of the present invention.

What is claimed is:

1. In a method of accumulating ice pieces in a storage tray by repeatedly performing the procedure of converting water into ice pieces in a container and then actuating a container-twisting mechanism for inverting and twisting the container to discharge at least most of the ice pieces into the storage tray, the improvement wherein during each said procedure said container is positioned so that the relative orientation between said container and storage tray when at least most of the ice pieces are discharged is different from said relative orientation occurring during a prior procedure, so that the ice pieces are distributed generally uniformly throughout the storage tray.

2. The method according to claim 1, wherein the twisting of the container involves rotating the container, said different relative orientations between the container and storage tray being accomplished by rotating the container in opposite directions.

3. The method according to claim 2, wherein each twisting of the container involves rotating the container so that one portion thereof contacts a stop surface while continuing to rotate another portion of the container.

4. The method according to claim 3, wherein said one portion of the container contacts a first stop surface when rotated in one direction, and contacts a second stop surface when rotated in the opposite direction, the first and second stop surfaces being spaced from one another.

5. The method according to claim 2, wherein said procedure comprises initially twisting the container in a first direction to discharge most of the ice pieces, subsequently twisting the container in a second direction to discharge residual ice pieces, and then returning the container to a water-receiving position, the initial twisting of the container in each procedure being performed in a direction opposite the initial twisting of the container performed in a prior procedure.

6. The method according to claim 1, wherein each procedure includes returning the container to a generally horizontal water-receiving position following the discharge of ice pieces.

7. The method according to claim 1, wherein each procedure is performed in response to the operation of an ice level-detecting mechanism which detects the level of ice in the storage tray relative to a reference level.

8. In a method of discharging ice pieces from a container to a storage tray disposed therebeneath by actuating a container-twisting mechanism for performing a two-step twisting sequence comprising initially twisting the container in an initial direction while the container is inverted above the storage tray to discharge at least most of the ice pieces toward a first region of the storage tray, and subsequently twisting the container in a direction opposite the initial direction while the container is inverted above the storage tray to discharge residual ice pieces toward a second region of the storage tray, the improvement wherein prior to each actuation of the container-twisting mechanism, a control mechanism connected thereto determines a prior initial direction of twisting performed during a prior two-step twisting sequence and directs the container-twisting mechanism to perform the initial twisting in a direction opposite the prior initial direction, so that ice pieces are generally uniformly distributed in the first and second regions of the storage tray.

9. The method according to claim 8, wherein each actuation of the container-twisting mechanism is performed in response to the operation of an ice level-detecting mechanism which detects the level of ice in the storage tray relative to a reference level.

10. The method according to claim 8, wherein the container is maintained in an upright horizontal orientation between successive two-step twisting sequences.

* * * * *